United States Patent [19]

Sheufelt et al.

[11] Patent Number: 4,575,738

[45] Date of Patent: Mar. 11, 1986

[54] INK JET PRINTING APPARATUS HAVING AN INK PRESSURE TRANSIENT SUPPRESSOR SYSTEM

[75] Inventors: Edward L. Sheufelt, Tigard; David B. Kreitlow, Portland, both of Oreg.; Jeffrey M. Hall, Walnut Creek, Calif.

[73] Assignee: Tektronix, Inc., Beaverton, Oreg.

[21] Appl. No.: 633,159

[22] Filed: Jul. 20, 1984

[51] Int. Cl.[4] ..... G01D 15/18

[52] U.S. Cl. ..... 346/140 R

[58] Field of Search ..... 346/140 IJ, 140 PD, 346/75

[56] References Cited

U.S. PATENT DOCUMENTS

| | | | |
|---|---|---|---|
| 3,761,953 | 9/1973 | Helgeson et al. | 346/140 IJ X |
| 4,106,032 | 8/1978 | Miura et al. | 346/140 PD |
| 4,223,324 | 9/1980 | Yamamori et al. | 346/140 PD |
| 4,301,460 | 11/1981 | Miura et al. | 346/140 PD |
| 4,347,524 | 8/1982 | Engel et al. | 346/140 PD |
| 4,380,018 | 4/1983 | Andoh et al. | 346/140 PD |

*Primary Examiner*—George H. Miller, Jr.

*Attorney, Agent, or Firm*—Francis I. Gray; David P. Petersen

[57] ABSTRACT

An ink jet printer includes a compact ink drop generating module (10) comprising an ink jet print head (14) mounted to a body (12) which contains high and low frequency ink pressure transient suppressing mechanisms (90, 68, 80). These mechanisms inhibit the ingestion of air into print head (14) and formation of print head clogging air bubbles. The body (12) also includes a purgeble bubble trap (72). Head (14) may be of the air assisted type. Air supplied to the head pressurizes ink at one side (82) of the diaphragm (80) and at the other side (84) of the diaphragm to increase the fluid capacitance of the diaphragm. The module (10) is easy to replace as a unit.

20 Claims, 4 Drawing Figures

INK JET PRINTING APPARATUS HAVING AN INK PRESSURE TRANSIENT SUPPRESSOR SYSTEM

TECHNICAL FIELD

This invention relates to ink jet printing apparatus, and in particular, to such apparatus having an ink drop generating unit with an ink pressure transient suppressor system.

BACKGROUND OF THE INVENTION

Ink jet printing apparatus having one or more ink jet heads for projecting drops of ink onto paper or other printing medium to generate graphic images and text have become increasingly popular. To form color images, apparatus with multiple ink jet printing heads are used, with each head being supplied with ink of a different color. These colored inks are then applied, either alone or in combination, to make a finished color print. Typically, all of the colors needed to make the print are produced from combinations of cyan (a blue-green), magenta (a blue-red), a yellow ink. In addition, black ink may be utilized for printing textual material or for producing true four color prints.

In a common arrangement, the print medium is attached to a rotating drum, with the ink jet heads being mounted on a traveling carriage that traverses the drum axially. As the heads scan spiral paths over the medium, ink drops are projected from a minute orifice in each head to form an image on the medium. A suitable control system synchronizes the generation of ink drops with the rotating drum.

There are two basic types of ink jet printing systems. In the first type, a stream of ink drops is produced continuously, but the stream is deflected away from the medium except when printing is desired. In the other type, ink drops are produced on demand. One such drop-on-demand printer is illustrated in U.S. Pat. No. 4,106,032 of Miura et al. In the Miura printer, an electric pulse applied to a piezoelectric crystal causes it to constrict whenever a drop of ink is needed. As a result, because the crystal is in intimate mechanical contact with an ink chamber in the print head, a pressure wave is transmitted through the ink chamber. This causes the formation at an internal drop-forming orifice of an ink drop, which is projected toward the printing medium. As they move toward the main external orifice leading to the medium, the drops of ink are entrained in a concentric air stream. This air stream increases the speed of the drops and accuracy of applying the drops to the print medium.

These known devices suffer from a number of drawbacks. Particulate material and air bubbles in the ink supplied to the print heads quickly clog the internal drop-forming orifice. Furthermore, pressure transients are generated in the ink supplied to the ink jet heads. These transients result from external factors, such as vibrations induced when ink cartridges are replaced, when the apparatus is jarred during use, and when the apparatus is moved. Whenever these ink pressure transients occur, and pressure in the ink supply lines drops, air may be taken in or ingested into the ink drop-forming orifice of the print head. This ingested air forms a bubble which clogs the print head and causes it to malfunction. Furthermore, it is a relatively time consuming and messy task to change the print heads of these prior art devices when a malfunction occurs.

U.S. Pat. No. 4,347,524 of Engel discloses a device which has a shock absorber for suppression of high frequency ink pressure transients in an ink jet printer. In a first embodiment, Engle feeds ink through a constricted piece of tubing and then through a chamber, partly filled with air, to an ink jet head. The air bubble in the chamber, together with the resistance created by the constricted tubing, forms a shock absorbing mechanism that is analagous to an electrical resistor-capacitor (RC) low pass filter. The capacitance of this device is dependent on the amount of air in the chamber. Furthermore, ink passing through the chamber can add to or absorb air from this bubble. As ink absorbs the air, the capacitance decreases. As a result, the RC time constant of the system decreases and degrades the performance of the system in damping pressure transients. In addition, during movement of the device air bubbles can be formed in the ink, leading to possible failure.

In his second embodiment, Engel positions a flexible diaphragm wall in his chamber. Although this eliminates problems with an air and ink interface, other drawbacks exist. For example, one side of the Engel diaphragm is apparently exposed to the atmosphere while the other side is exposed to ink. As a result, a relatively high pressure differential develops across the diaphragm. This decreases the capability of the Engel apparatus to act as a fluid capacitor. As a result, the RC time constant of the system decreases.

Moreover, none of the Engel embodiments prevents air bubbles and particles in the ink supply stream from reaching and clogging the ink jet print head. In addition, the Engel apparatus does not effectively dampen low frequency, long duration pressure drops in the ink supply line. Such pressure transients also may cause the ingestion of an air bubble into the ink jet head and a corresponding clogging of the print head.

IBM Technical Disclosure Bulletin, Volume 25, No. 2, pages 772–774 published in July 1982 contains two bulletins directed to ink jet printer devices. One of the bulletins discloses the use of check valves in an ink jet printer system for the elimination of reverse ink flow. The purpose of these check valves is to prevent paper fibers and other contaminants from being drawn into the print head where they could plug the head. Thus bulletin also shows a filter positioned within an ink inlet line of an ink jet head for filtering contaminants from ink that is diverted away from the printing medium. The other bulletin discloses the use of a surge pressure orificed check valve in an ink jet printer. The IBM devices do not, however, satisfactorily address the problem of air ingestion into an ink jet head. Such air ingestion results from, for example, relatively high frequency pressure transients that can occur in an ink supply line.

Therefore, a need exists for an improved ink jet printing apparatus directed to overcoming these and other disadvantages of prior art devices.

SUMMARY OF THE INVENTION

An ink jet printer in accordance with the present invention includes a compact ink drop generating module comprising an ink jet head mounted to a housing or body that contains an ink pressure transient suppressing system. The suppressing system includes high and low frequency pressure transient suppressing mechanisms which attenuate pressure transients in the ink supply line to the module and thereby minimize or block negative changes in the ink line pressure. Consequently, the ingestion of air and formation of print head clogging air bubbles in the print head is substantially reduced or eliminated.

As a more specific feature of the invention, the pressure transient suppressing system includes a low frequency bandpass pressure dampening mechanism comprised of a flow restriction element in combination with a diaphragm element. This mechanism is operable in a manner analogous to the electrical performance of an RC low bandpass filter.

As another feature of the invention, the restrictive element comprises a filter designed to remove print head clogging air bubbles and particulate materials from the stream of ink flowing to the drop generating module.

As a further feature of the invention, the module includes an air assisted print head. The air supplied to the print head is also used to pressurize one side of the diaphragm. The other side of the diahragm is in contact with ink. With this construction, the fluid capacitance of the diaphragm is enhanced because a relatively low pressure differential is maintained across the diaphragm. As a result, a relatively high RC time constant and improved ink pressure transient dampening are achieved.

In addition, a common air source is utilized to pressurize the diaphragm and the ink supply. Therefore, changes in air pressure produce corresponding changes in the ink pressure. This has the effect of maintaining the fluid capacitance of the diaphragm at a relatively constant level because the pressure differential across the diaphragm remains the same even though the air pressure changes. Therefore, ink pressure transients are suppressed even under widely fluctuating air supply pressures, such as when the air supply is off.

As another feature of the invention, the low frequency pressure transient suppression mechanism compensates for drops in ink supply pressure of a relatively long duration. As a result, the ingestion of bubbles into the print head is inhibited under these conditions as well. This latter mechanism, in one form, comprises a check valve for preventing the back flow of ink from the print head. As a more specific feature, the check valve includes a valve closing disk of a specific gravity which is less than the specific gravity of the ink flowing through the valve. Also, the valve is oriented such that the disk tends to float to a valve closed position. This enhances the rapidity of the response of the low frequency transient suppressor to drops in pressure in the ink supply line. The small amount of fluid necessary to close the check valve is supplied by the fluid capacitance, instead of by the liquid meniscus at the ink jet head. This significantly improves the protecting ability of the device over either a diaphragm or check valve alone.

As another feature of the invention, operable in conjunction with, as well as separately from the pressure transient suppression system, air trapped by the filter is collected in an air trap to prevent the air from forming print head clogging bubbles. This trapped air is vented as needed.

As still another feature of the invention, the ink drop generating module is mounted to a carriage of the printer in a manner which permits its easy removal and replacement with another module, in the event such replacement becomes necessary.

Therefore, it is one object of the present invention to provide an improved ink jet printer which minimizes malfunctions and clogging of the print head of the printer.

It is still another object of the invention to provide such an apparatus that is capable of attenuating and suppressing both high and low frequency ink pressure transients in the apparatus.

A further object of the invention is to provide an ink drop generating module that minimizes the clogging of the print head with air and particulate contaminants from ink supplied to the print head.

A further object of the invention is to provide a modular ink drop generating unit that is mechanically simple and compact.

Still another object of the invention is to provide a low maintenance ink drop generator that is easy to replace and prevents the leakage of ink during replacement.

These and other objects, features and advantages of the present invention will be apparent from the following detailed description and drawings.

DETAILED DESCRIPTION OF A PREFERRED EMBODIMENT

Figure 1:
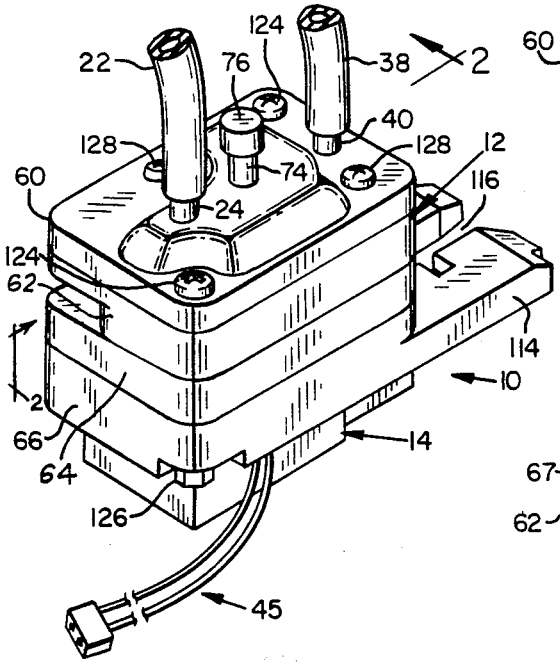
FIG. 1 is an isometric view of an ink drop generating module in accordance with the present invention.
Figure 2:
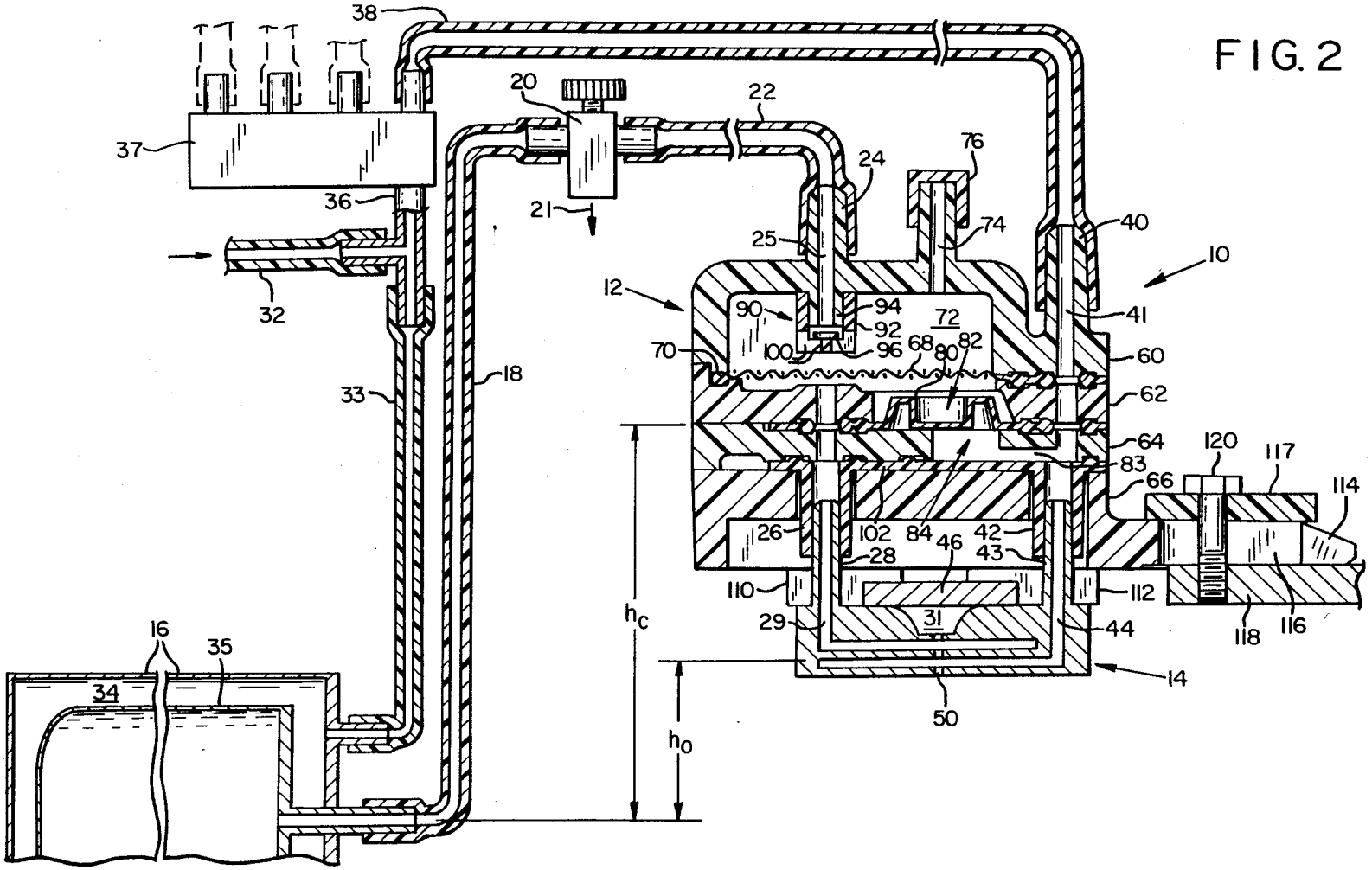
FIG. 2 is a cross sectional view of the module of FIG. 1, taken along line 2—2 thereof, together with additional elements of an ink printing apparatus.

With reference to FIGS. 1 and 2, an ink drop generating module 10 is shown for applying ink to paper or other printing medium. Module 10 is a compact unit having a body 12 which contains an ink pressure transient suppression system explained below, and an ink jet printing head 14 mounted to the body. Ink is supplied by an ink cartridge 16 and flows through conduits 18, a three-way valve 20 having an air bleed position for bleeding air from the line at 21, and a conduit 22 to an ink inlet 24 of the body. Inlet 24 communicates with an ink flow passageway 25 which passes through the interior of body 12 to an ink outlet 26. From outlet 26, the ink enters the print head 14 through an ink receiving inlet 28 of the head and flows in a passageway 29 to an ink chamber 31.

Although other print heads may be used, in the illustrated embodiment, head 14 is of the air assisted drop-on-demand type, such as disclosed in U.S. Pat. No. 4,106,032 of Miura, et al. With this particular print head, a source of pressurized air is required. This pressurized air is delivered along a line 32, a line 36 and to a manifold 37. The air passes along a line 38 from manifold 37 to an air inlet 40 of the body 12. Manifold 37 includes additional outlets leading to other, similar modules. In body 12, air passes along a passageway 41 and through the body to an air outlet 42, and then to an air inlet 43 leading to an air passage 44 in the head.

Pressurized air from the source is also directed by a conduit 33 to an interior cavity 34 of the ink cartridge. This air pressure forces ink from a flexible collapsible ink-containing bag through conduit 18 and to module 10.

The head 14 is scanned over the printing medium in a conventional manner. Whenever printing is desired, an electric pulse is applied via leads 45 (FIG. 1) to a piezoelectric crystal 46 (FIG. 2) in the head. When pulsed, the crystal produces a pressure wave which forces ink from chamber 31 toward an orifice 50 of the head. As the ink droplet moves towards the orifice, a concentric air stream from air passageway 44 accelerates the speed of the ink droplet toward the printing medium.

The print heads 14 of ink jet printers, whether of the air assisted or non-air assisted type, are subject to clogging by any particulate material in ink supplied to the head. Such clogging also results from air bubbles entrained within and carried by the ink delivered to the head.

In an air assisted ink jet printing head, the differential in pressure between the pressure of ink in passageway 29 and the pressure of the air in passageway 41 is important, with the optimum differential for a particular head usually being specified by the manufacturer of the head. As a convenient and known way of initially establishing this differential, the head is elevated a distance $h_o$, relative to the elevation of the ink cartridge.

However, pressure fluctuations occur in the ink supply passageways during normal operation of an ink jet printer. These pressure differentials result from, for example, bumping the printer during use or transportation, replacing ink supply cartridges, and jarring the ink supply lines. Whenever the pressure in the ink supply passage 29 drops relative to the pressure in air supply passageway 41, there is a risk that air will be ingested into the ink drop forming portion of the head and form a bubble at the outlet of chamber 31. When this happens, the head clogs and ceases to print. This problem of air ingestion is also present in non-air assisted ink jet printers.

To minimize these problems, a transient pressure suppressing system is included within the body 12 for suppressing and attenuating high and low frequency pressure transients in the ink supply line to module 10. This minimizes pressure drops within the ink supply line and the risk of ingestion of print head clogging bubbles. Furthermore, there is provided within the body 12 a mechanism for trapping air bubbles and contaminants carried in the stream of ink reaching the head.

Figure 3:
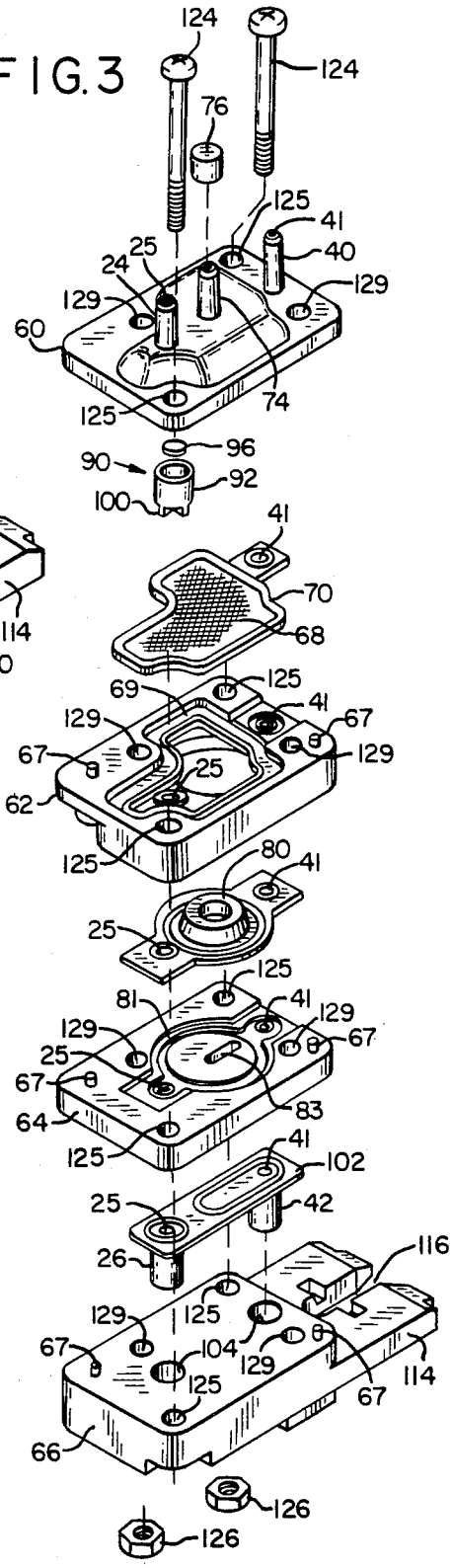
FIG. 3 is an exploded isometric view of the ink transient suppressor system of the FIG. 1 module.

In the illustrated embodiment, the body 12 is of multi-section construction, best seen with reference to FIG. 3. In particular, body 12 includes a valve body supporting and bubble trapping section 60, an ink filter supporting or seating section 62, a diaphragm body supporting section 64 and a head holder section 66 to which the printing head 14 is attached, as explained below. Each of these body sections is provided with a pair of pins 67 which mate with corresponding openings in the adjacent body portion to align and interlock the body sections.

With reference to FIG. 2, ink passing through ink supply inlet 24 and along the ink passageway 25 enters a chamber 72 defined within the body section 60. The ink flows from chamber 72 through a filter 68 and continues along the passageway 25 to the printing head. Filter 68 is designed to filter out particulate matter and bubbles of a size that could intefere with the functioning of the head. As one example, filter 68 may comprise a 5 micron mesh stainless steel screen formed integrally with a surrounding gasket 70 (FIGS. 2 and 3). This filter is positioned between the body sections 60 and 62 and is received within a seat 69 of the filter supporting body section 62. The gasket 70 seals the space between these body sections and also seals the air passageway 41 at the point where it passes between these sections. Any entrained air bubbled reaching filter 68 are blocked from continuing in the passageway 25 to the ink head. These trapped bubbles rise and collect within the chamber 72. A purging vent 74, normally closed by a cap 76, is opened to the atmosphere as needed to remove air from the chamber 72. Air trapped within chamber 72 is forced out through vent 74 by removing cap 76 and delivering ink to the chamber.

Short duration pressure transients in the ink line pressure, particularly high frequency variations, can result in pressure drops in the ink pressure supply passage. These pressure drops can cause the ingestion of air within the drop-forming portion of the head and the formation of a print head clogging air bubble. To attenuate these pressure transients, and to minimize or eliminate negative pressure drops in the ink supply lines, the body 12 contains a high frequency ink transient suppressor mechanism. In the illustrated form, the mechanism comprises filter 68, which restricts ink flow somewhat, and a diaphragm 80. This pressure transient suppressor operates in a manner which is analogous to a low band-pass electrical RC filter. A large fluid filter RC time constant is desired in order to maximize high frequency pressure transient attenuation. However, is is also important that the RC time constant be much lower than the air supply system time constant so as to avoid air ingestion during system start up. Furthermore, it is desirable that the resistive component of the RC filter offer relatively low resistance to the fluid flow so as to not impede the normal direct current flow rate of ink through the module. Correspondingly, to achieve a high RC time constant with a low resistance, a relatively high capacitance is preferred.

In the transient suppressor of the preferred embodiment, as mentioned, the filter 68 comprises the resistive component of the RC ink pressure transient suppressor. The capacitance component of the suppressor is provided by the diaphragm 80. Diaphragm 80 is received within a correspondingly shaped seat 81 of the diaphragm body supporting section 64. Also, this diaphragm is formed as part of a gasket which seals both the ink passageway 25 and air passageway 41 at the location where these passageways extend between the body sections 62 and 64.

As can be seen from FIG. 2, an ink accumulating region 82 is provided at the ink side of the diaphragm 80. The opposite side of the diaphragm is exposed to an air receiving chamber 84 which communicates, via a passageway 83, with the air supply passageway 41. Therefore, the air from line 32 not only provides pressure to the ink cartridge 16, as previously explained, but also pressurizes one side of the diaphragm. This offers a number of advantages.

The capacitance, C, of a flat diaphragm is expressed by the following known formula:

$$C = \frac{.362\ r_w^{(10/3)}}{(P_{air} - P_{ink})^{\frac{2}{3}}} \left[ \frac{1}{E_t} \right]^{\frac{1}{3}}$$

where $r_w$ equals the radius of the diaphragm (the unclamped portion), t equals the diaphragm thickness, and E equals the elastic modulus of the diaphragm. From this formula, it is apparent that the lower the pressure differential across the diaphragm, the higher the capacitance provided by the diaphragm. In theory, it would be desirable to reduce this pressure differential to zero. However, for the printing head 14 to operate, a pressure differential between the ink and air is required at the head. Consequently, after $h_o$ is established to provide the desired relative pressure difference between the ink and air at the head, the pressure across the diaphragm is determined by the elevation $h_c$. In a typical example, with the head orifice pressure differential at 3.0 inches of water, the differential across the diaphragm is approximately 3.5 inches of water. Because of this relatively low pressure differential across the diaphragm, a very high capacitance can be obtained from a small diaphragm. This reduces the size of body 12. Furthermore, the low resistance to fluid flow, due to the filter 68, still results in a relatively high RC time constant because of relatively high capacitance achieved with this construction.

As another advantage of this embodiment, the capacitance is virtually independent of the air pressure. That is, as is apparent from the above formula, the capacitance is related to the difference between the ink pressure and air pressure across the diaphragm. Also, ink is pressurized by the same air supply which pressurizes the air side 84 of the diaphragm 80. Therefore, variations in the air supply pressure have a similar effect on the ink supply pressure. As a result, the differential across the diaphragm, and thereby the capacitance, is virtually constant even though the air pressure fluctuates. As a result, even if the air supply system happens to be turned off, for example when the printer is moved, capacitance is still present in the pressure transient suppressor system. Thus, pressure transients are attenuated in the same manner as if the air supply system were on.

This transient suppressor is also applicable to non-air assisted ink jet printers. In such a case, the chamber 84 may be pressurized from an air supply used to pressurize the ink cartridge. Alternately, chamber 84 may either be exposed to the atmosphere or pressurized by a different source. When exposed to the atmosphere, the pressure differential across the diaphragm approaches 30 inches of water. For a given diaphragm, this reduces the capacitance provided by the diaphragm in comparison to a system in which the air side of the diaphragm is pressurized. If the same RC time constant is desired, this effect can be counteracted by increasing the size of the diaphragm, by increasing the resistance, or by a combination of both.

In addition to the high frequency pressure transient suppressing mechanism, the module also includes a mechanism for suppressing low frequency variations in ink pressure. This latter mechanism compensates for drops in ink pressure relative to air pressure of too long a duration to be significantly attenuated by the RC low pass fluid filter.

In the illustrated embodiment, this low frequency pressure transient suppressor mechanism comprises a check valve 90 which closes in the event of a pressure drop in the ink supply system upstream of the valve. When closed, the valve inhibits the ingestion of air into the head. With reference to FIG. 2, check valve 90 includes a cylindrical housing 92 having its four lower quadrants removed at 100 to provide fluid flow orifices. The housing 92 fits over a stem 94 which projects downwardly from the upper interior surface of the body section 60.

Figure 4:
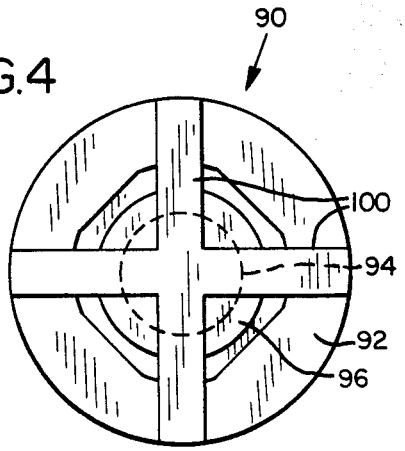
FIG. 4 is a bottom plan view of a check valve incorporated into the ink suppressor system of FIG. 1.

A valve or disk 96 moves freely within the housing 92. When the disk is in the position shown in FIG. 2 (see also FIG. 4), fluid passes along the ink passageway 25 and through the valve orifices. When the disk 96 is seated against the stem 94, the passageway 25 is closed. As mentioned above, disk 96 closes the valve in response to a drop in pressure in the ink supply line upstream of the check valve 90. To facilitate the functioning of the module, the housing 92 has an upright longitudinal axis and the disk 96 is formed of a material which has a specific gravity which is lower than that of the ink. Therefore, the disk 96 naturally tends to float upwardly into a seated position against stem 94. This floating action biases the valve to a closed position and decreases the time required for disk 96 to close the valve when the ink pressure drops. In addition, the ink from chamber 72 assists in moving the disk 96 to a closed position. That is, when a long term pressure drop occurs, the diaphragm 80 moves away from air chamber 84 and toward the fluid accumulator chamber 82. This diaphragm movement forces fluid in a direction which aids the seating of disk 96.

More specifically, the specific gravity of the ink varies somewhat with the color of the ink, but 1.04 is typical. The disk may be made of a suitable material, such as a rubber known generically as EPDM and having a specific gravity of from 0.9 to 1. Thus, the ink pressure transient suppressor alternates changes in ink pressure so as to minimize pressure drops in the ink supply system of a magnitude which would cause the ingestion of air into the print head.

For sealing purposes, a gasket 102 is positioned between the diaphragm supporting section 64 and the head holding section 66. Sleeves 26 and 42 which receive the respective head inlets 28 and 43 are formed as part of gasket 102. In addition, the sleeves 26 and 28 fit within respective sleeve receiving apertures 104 of the head supporting body section 66.

The ink drop generating module 10 is mounted by the head holder body section 66 to the carriage of the printer in the following manner. The head holder body section 66 includes a mounting bracket 114 having a slot 116. The bracket 114 rests on a carriage connecting bracket 118 which is a part of the carriage of the printer. A carriage fastener screw 120 passes through a spacing block 117, the slot 116, and is threaded into the carriage supporting bracket 118 to secure module 10 to the carriage. In a typical printer, plural modules are provided side by side. It then becomes necessary to align the orifices 50 so that they converge on a common path on the printing medium. This convergence adjustment may be accomplished in the present invention by loosening carriage screw 120, moving the module to the desired position, and then retightening the screw.

Head spacing legs 110, 112 project downwardly from the lower exterior surface of head holding body section 66. It is important to establish the distance between the head and printing medium, in accordance with tolerances typically provided by manufacturers of printing heads. The legs 110, 112 are formed of different lengths, depending on the head, to establish the necessary spacing. That is, the body 12 is held on the carriage mounting bracket 118 in a fixed position relative to the printing medium. Also, ink jet head 14 rests against the legs 110, 112. Therefore, the length of the legs 110, 112 establishes the distance between the head orifice 50 and the medium.

The entire body assembly 12 is held together by fasteners 124 which extend through openings 125 in the respective body sections and are secured by nuts 126 (see FIG. 3). Also, ink printing head fasteners 128 (FIG. 1) extend through respective openings 129 (FIG. 3) of the body sections and are threaded into the upper surface of the head 14 to secure the head to the body.

In operation, because the body 12, including the pressure transient suppressing mechanism system and ink jet head are connected together to form module 10, the module may easily be replaced in the event the printing head 14 becomes plugged. This is accomplished simply by loosening carriage screw 120 and sliding the bracket 114 free from the fastener 120. Slot 116 allows this to be accomplished. In addition, the ink supply conduit 18 may be temporarily closed, as by a hemostat, and disconnected from valve unit 20. Likewise, the air supply conduit 38 may be pulled free from manifold 37. Then, the replacement module 10, including a new air line 38 and a valve unit 20 is placed in position and screw 120 is tightened. This unit is initially filled with fluid to eliminate air bubbles. Bleed line 21 of valve 20 is opened and ink passed through the valve to bleed any air that may have been trapped in the line 18 during this procedure. After the air is bled from the line 18, valve 20 is opened to permit the flow of ink to the head. In addition, the new air suppy conduit 38 is attached to the manifold 37 and the installation is complete. This entire procedure can be accomplished in many cases in approximately a minute without any ink mess. Furthermore, with adjacent modules being protected with pressure transient suppressing systems, shocks to the system occurring during replacement of a module are suppressed.

Also, because the transient suppressing system and printing head are mounted to one another, the proximity of these mechanisms enhances the performance of the module in suppressing pressure variations in the ink supply line.

In addition, the ink drop generating module of the present invention appears to start printing faster, in response to a pulse on piezoelectric crystal 46, than a similar device that lacks an ink pressure transient suppressor. When printing first starts, there is an apparent small pressure drop in the ink suppy passageway 25. In response, diaphragm 80 moves toward chamber 82 and delivers ink from inside body 12 to the ink head 14. The diaphragm 80 returns to its initial equilibrium condition as steady state ink flow through the passageway 25 is achieved.

As previously explained, filter 68 traps particulate matter and air bubbles in the ink stream, which otherwise have the potential of clogging the head 14. Furthermore, the resistance to fluid flow, provided by filter 68, in conjunction with the action of the diaphragm 82 provides a high frequency fluid filter for damping out pressure variations in the supply passageway 25. These pressure transients otherwise could cause the ingestion of air in the head. Air ingestion resulting from low frequency or long duration pressure drops in the ink supply passageways is inhibited by the check valve 90.

Having illustrated and described the principles of our invention with reference to one preferred embodiment, it should be apparent to those persons skilled in the art that such invention may be modified in arrangement and detail without departing from such principles. We claim as our invention all such modifications as come within the true spirit and scope of the following claims.

We claim:

1. Ink drop generating apparatus for printing on a medium with ink, comprising:

a body;

ink jet print head means mounted to the body, the ink jet print head means having an ink receiving port and an outlet orifice through which ink drops are delivered to the print medium;

the body having an upstream ink receiving inlet and defining an ink flow passageway through which ink is delivered from the ink receiving inlet downstream to the ink receiving port of the ink jet print head means; and ink pressure transient suppression means within the body for attenuating ink pressure transients so as to inhibit the ingestion of air and the formation of an ink flow blocking air bubble within the ink jet print head means.

2. An ink drop generating apparatus according to claim 1 in which the ink pressure transient suppression means includes fluid band pass filter means for attenuating high and low frequency ink pressure transients.

3. An ink drop generating apparatus according to claim 1 in which the ink jet print head means is of the air assisted type having an air receiving port, the body having an upstream air receiving inlet and defining an air flow passageway through which air is delivered from the air receiving inlet to the air receiving port of the ink jet print head means.

4. An ink drop generating apparatus according to claim 1 in which the ink jet print head means is mounted directly to the body.

5. An ink drop generating apparatus according to claim 1 including filter means in the ink flow passageway for fitering potentially ink jet print head means clogging air bubbles from ink flowing within the ink flow passageway;

the body including an air trapping member positioned upstream of the filter means in the ink flow passageway for collecting air removed by the filter means from ink in the ink flow passageway.

6. An ink drop generating apparatus according to claim 5 including means for venting the air trapping chamber to remove the collected air from the body.

7. An ink drop generating apparatus according to claim 1 in which the ink pressure transient suppression means includes a flow restriction means in series with the ink flow passageway and a diaphragm means in parallel with the ink flow passageway, the diaphragm means having a first side which is exposed to the ink flow passageway.

8. An ink drop generating apparatus according to claim 7 in which the ink pressure transient suppression means includes check valve means in the ink flow passageway for preventing the reverse flow of ink in the ink flow passageway from the body to the ink receiving inlet.

9. An ink drop generating apparatus according to claim 7 in which the diaphragm means includes a second side opposite to the first side of the diaphragm means, the ink drop generating apparatus also including means for applying air pressure to the second side of the diaphragm means.

10. An ink drop generating apparatus according to claim 9 in which the means for applying air pressure further comprises means for applying air pressure to ink which is delivered to the ink receiving inlet so that variations in air pressure have substantially no effect on the pressure differential across the diaphragm means.

11. An ink drop generating apparatus according to claim 7 in which the ink jet print head means is of the air assisted type having an air receiving port, the body having an upstream air receiving inlet and defining an air flow passageway through which air is delivered from the air receiving inlet to the air receiving port of the ink jet print head means, the diaphragm means including a second side opposite to the first side of the diaphragm means, the body defining a diaphragm pressurizing air passageway communicating with the second side of the diaphragm means.

12. An ink drop generating apparatus according to claim 11 further comprising an ink cartridge means which includes a collapsible ink container means therein, means for delivering ink from the ink container means to the ink receiving inlet of the body, and air delivery means for delivering air from an air source to the cartridge so as to apply pressure to the ink container means and cause the delivery of ink to the ink receiving inlet; the air delivery means also comprising means for delivering air from the air source to the air receiving inlet, such that variations in air pressure in air delivered from the air source have substantially no effect on the pressure differential across the diaphragm means.

13. An ink drop generating apparatus according to claim 7 in which the flow restriction means comprises filter means for removing ink jet print head means clogging air bubbles and particulates from ink flowing in the ink flow passageway.

14. An ink drop generating apparatus according to claim 13 in which the body defines an air bubble collecting region upstream of the filter means for receiving air bubbles removed by the filter means and air venting means for purging trapped air from the bubble collecting region.

15. An ink drop generating apparatus according to claim 14 in which the ink pressure transient suppression means includes, in the ink flow passageway upstream of the filter means, a check valve means for preventing the reverse flow of ink in the ink flow passageway from the body to the ink receiving inlet as a result of a drop in the pressure of ink supplied to the ink receiving inlet.

16. Ink jet printing apparatus having a carriage and an ink drop generating module carried by the carriage for printing images on a print medium, said module comprising:

a body;

ink jet print head means mounted to the body to comprise the module, the ink jet print head means having an ink receiving port and an outlet orifice through which ink is delivered to the print medium;

the body having an upstream ink receiving inlet and defining an ink flow passageway through which ink is delivered from the ink receiving inlet downstream to the ink receiving port of the ink jet print head means;

ink pressure transient suppression means within the body for attenuating ink pressure transients so as to inhibit the ingestion of air and the formation of an ink flow blocking air bubble within the ink jet print head means;

the ink jet print head means being mounted directly to the body;

the body including mounting means for releasably mounting the body, and thereby the ink drop generating module, to the carriage; whereby the mounting means can be released to allow removal of the module as a unit.

17. A modular ink jet applicator for applying ink to a print medium, comprising:

a body;

ink jet print head means mounted to the body, the ink jet print head means having an ink receiving port and an outlet orifice through which ink is delivered to the print medium;

the body having an upstream ink receiving inlet and defining an ink flow passageway through which ink is delivered from the ink receiving inlet downstream to the ink receiving port of the ink jet print head means;

ink pressure transient suppression means within the body for attenuating ink pressure transients so as to inhibit the ingestion of air and the formation of an ink flow blocking air bubble within the ink jet print head means;

the apparatus including filter means in the ink flow passageway for filtering potentially print head means clogging air bubbles from ink flowing within the ink flow passageway;

the body including an air trapping chamber means positioned upstream of the filter means in the ink flow passageway for collecting air removed by the filter means from ink in the ink flow passageway;

means for venting the air trapping chamber means to remove the collected air from the body;

the ink transient suppression means including diaphragm means in parallel with the ink flow passageway, said diaphragm means having a first side which is exposed to the ink flow passageway, the diaphragm means cooperating with the filter means to attenuate ink pressure transients in a manner analogous to an electrical RC filter.

18. An applicator according to claim 17 in which the ink jet print head means is of the air assisted type having an air receiving port, the body having an upstream air receiving inlet and defining an air flow passageway through which air is delivered from the air receiving inlet to the air receiving port of the ink jet print head means, the diaphragm means having a second side which is opposite to the first side of the diaphragm means, the body defining a diaphragm pressurizing air passageway communicating with the second side of the diaphragm means.

19. An applicator according to claim 18 in which the ink pressure transient suppression means includes check valve means in the ink flow passageway upstream of the filter means for preventing the reverse flow of ink in the ink flow passageway from the body to the ink receiving inlet as a result of a drop in the pressure of ink supplied to the ink receiving inlet.

20. An applicator according to claim 19 in which the check valve means comprises a housing, a disk within the housing movable from a first position in which the ink flow passageway is closed to a second position in which the ink flow passageway is open, the disk having a specific gravity which is less than the specific gravity of ink in the ink flow passageway such that the disk floats in the ink, the valve means being oriented such that the disk floats toward the first position.

* * * * *